US011790718B2

(12) United States Patent
Djoudi

(10) Patent No.: US 11,790,718 B2
(45) Date of Patent: Oct. 17, 2023

(54) VOTING METHOD AND DEVICE AND BALLOT SHEET

(71) Applicant: Abdelhakim Djoudi, Montpellier (FR)

(72) Inventor: Abdelhakim Djoudi, Montpellier (FR)

( * ) Notice: Subject to any disclaimer, the term of this patent is extended or adjusted under 35 U.S.C. 154(b) by 98 days.

(21) Appl. No.: 17/593,242

(22) PCT Filed: Mar. 16, 2020

(86) PCT No.: PCT/FR2020/050572
§ 371 (c)(1),
(2) Date: Sep. 14, 2021

(87) PCT Pub. No.: WO2020/188217
PCT Pub. Date: Sep. 24, 2020

(65) Prior Publication Data

US 2022/0157107 A1 May 19, 2022

(30) Foreign Application Priority Data

Mar. 15, 2019 (FR) ..... 1902707

(51) Int. Cl.
*G07C 13/00* (2006.01)

(52) U.S. Cl.
CPC ..... *G07C 13/00* (2013.01)

(58) Field of Classification Search
CPC ..... G07C 13/00
USPC ..... 235/51
See application file for complete search history.

(56) References Cited

U.S. PATENT DOCUMENTS

2010/0252628 A1 10/2010 Chung
2012/0126018 A1 5/2012 Djoudi

OTHER PUBLICATIONS

ISR: European Patent Office; Netherlands; dated Aug. 10, 2020.

*Primary Examiner* — Daniel A Hess
(74) *Attorney, Agent, or Firm* — Patshegen IP; Moshe Pinchas

(57) ABSTRACT

The voting method (30) comprises:
- a step (32) of a voter selecting a candidate or a proposition put to a vote, using an interface of a terminal (11);
- a step (34) of the terminal writing information representative of the choice made by the voter to the memory (25) of a ballot sheet,
- a step (35) of printing (22) the choice made by the voter on the surface of the ballot sheet,
- a step (36) of dispensing the printed ballot sheet (20) to be slid into a ballot box (15),
- a step (38, 39) of inserting the ballot sheet into the ballot box,
- a step (40) of the ballot box (15) reading the memory of the ballot sheet,
- a step (42) of storing the numbers of ballots expressing the various possible choices,
- a step (33) of the terminal determining a unique code, unique for at least the ongoing ballot, independent of the identity of the voter, of the order of arrival of the voter or of any document that may have been issued prior to the time when the ballot sheet was issued, and
- a step (34) of writing the indeterminable code to the memory of the ballot sheet.

13 Claims, 2 Drawing Sheets

VOTING METHOD AND DEVICE AND BALLOT SHEET

TECHNICAL FIELD OF THE INVENTION

The present invention relates to a voting method and device and a ballot sheet. It applies, in particular, to the field of civic or professional elections.

STATE OF THE ART

Paper-based voting procedures are known. Each voter confidentially places a paper ballot sheet bearing his choice (a candidate in an election or a proposal put to a vote) in an opaque envelope and then slides this envelope into a ballot box. When voting is closed, the ballot box is opened and the ballot sheets are counted by visual reading.

This procedure is slow, makes ballot box jamming possible and leads to the validity of ballot sheets being contested.

As a result, the Administrative Tribunals regularly annul elections if contested and if the result of the vote is close.

Electronic voting machines, on which the voters choose a candidate or proposal on a screen, are known. These machines are subject to electronic fraud and no verification is possible since there is no physical medium for the votes cast.

DESCRIPTION OF THE INVENTION

The present invention aims to remedy all or part of these drawbacks.

To this end, according to a first aspect, the present invention relates to a voting device, which comprises:

- a terminal for selecting a candidate or a proposal put to a vote, comprising an interface with which a voter makes a choice, the terminal comprising:
  - a means for writing information representative of the choice made by the voter to the memory of the ballot sheet,
  - a means for printing the choice made by the voter on the surface of the ballot sheet, and
  - a means for dispensing the printed ballot sheet to be slid into a ballot box; and
- the ballot box equipped with a reader of the memory of the ballot sheet and storage of the numbers of ballot sheets expressing the various possible choices, the terminal comprising a means for determining a code that is unique for at least the ballot in progress, independent of the identity of the voter, of the order of arrival of the voter or of any document that may have been issued prior to the time when the ballot sheet was issued, and a means for writing the indeterminable code to the memory of the ballot sheet.

Thanks to these provisions, firstly the voter can verify that his choice is expressed by his ballot sheet since his choice is printed on this ballot sheet and, secondly, the result of the ballot is known as soon as voting closes by reading the memory of the ballot reader. In addition, the vote can be verified by recounting the ballots visually, and the vote's anonymity is certified since it is not possible for someone who has placed blank ballot sheets which all have different numbers, for example sequential, to find out which voter made which choice.

In some embodiments, several ballot sheets keep the same identifier in memory (24), before being dispensed by the terminal, and, when the ballot sheet is issued, the terminal completes this identifier with the unique code, to ensure that all the completed identifiers issued during a ballot are different.

In some embodiments, all the ballot sheets used for a ballot keep the same identifier in memory, before being dispensed by the terminal.

Thanks to each of these provisions, the ballot can be identified based on the ballot sheet.

In some embodiments, the means for determining a unique code comprises a means of generating a random code from among the codes not yet allocated to other ballot sheets.

Thanks to these provisions, the random code, for example dependent on the generation time, is totally unpredictable and indeterminable.

In some embodiments, the ballot sheets are connected mechanically to each other in the form of a strip, the terminal comprising a means for cutting the ballot sheet strip so as to dispense the ballot sheets separately.

In some embodiments, the strip is coiled on itself to form a roll.

In some embodiments, the ballot sheets are connected to each other by thinned areas enabling their separation.

In some embodiments, the ballot sheets form a pile of ballot sheets in the terminal.

In some embodiments, each ballot sheet comprises an electronic tag using the RFID (acronym for "Radio Frequency Identification") protocol.

In some embodiments, each electronic tag comprises a rewritable memory area to receive the unique code from the terminal.

In some embodiments, the device comprises a means for printing a voting receipt comprising at least one portion of the unique code.

In some embodiments, the means for printing the voting receipt is configured to print the voter's choice on the voting receipt.

Thanks to each of these provisions, the voter can verify that his vote has been taken into account correctly when the list of codes and ballots cast is displayed, for example on a website.

According to a second configuration, the present invention relates to a voting method, which comprises:

- a step of a voter selecting a candidate or a proposition put to a vote, using an interface of a terminal;
- a step of the terminal writing information representative of the choice made by the voter to the memory of a ballot sheet;
- a step of printing the choice made by the voter on the surface of the ballot sheet;
- a step of dispensing the printed ballot sheet to be slid into a ballot box;
- a step of inserting the ballot sheet into the ballot box;
- a step of the ballot box reading the memory of the ballot sheet;
- a step of storing the numbers of ballot sheets expressing the various possible choices;
- a step of the terminal determining a code that is unique for at least the ballot in progress, independent of the identity of the voter, of the order of arrival of the voter or of any document that may have been issued prior to the time when the ballot sheet was issued; and
- a step of writing the indeterminable code to the memory of the ballot sheet.

As the particular features, advantages and aims of this method are similar to those of the device that is the subject of the present invention, they are not repeated here.

BRIEF DESCRIPTION OF THE FIGURES

Other advantages, aims and particular features of the invention will become apparent from the non-limiting description that follows of at least one particular embodiment of the device and method that are the subjects of the present invention, with reference to drawings included in an appendix, wherein.

DESCRIPTION OF EXAMPLES OF REALIZATION OF THE INVENTION

Note that the figures are not to scale.

Figure 1:
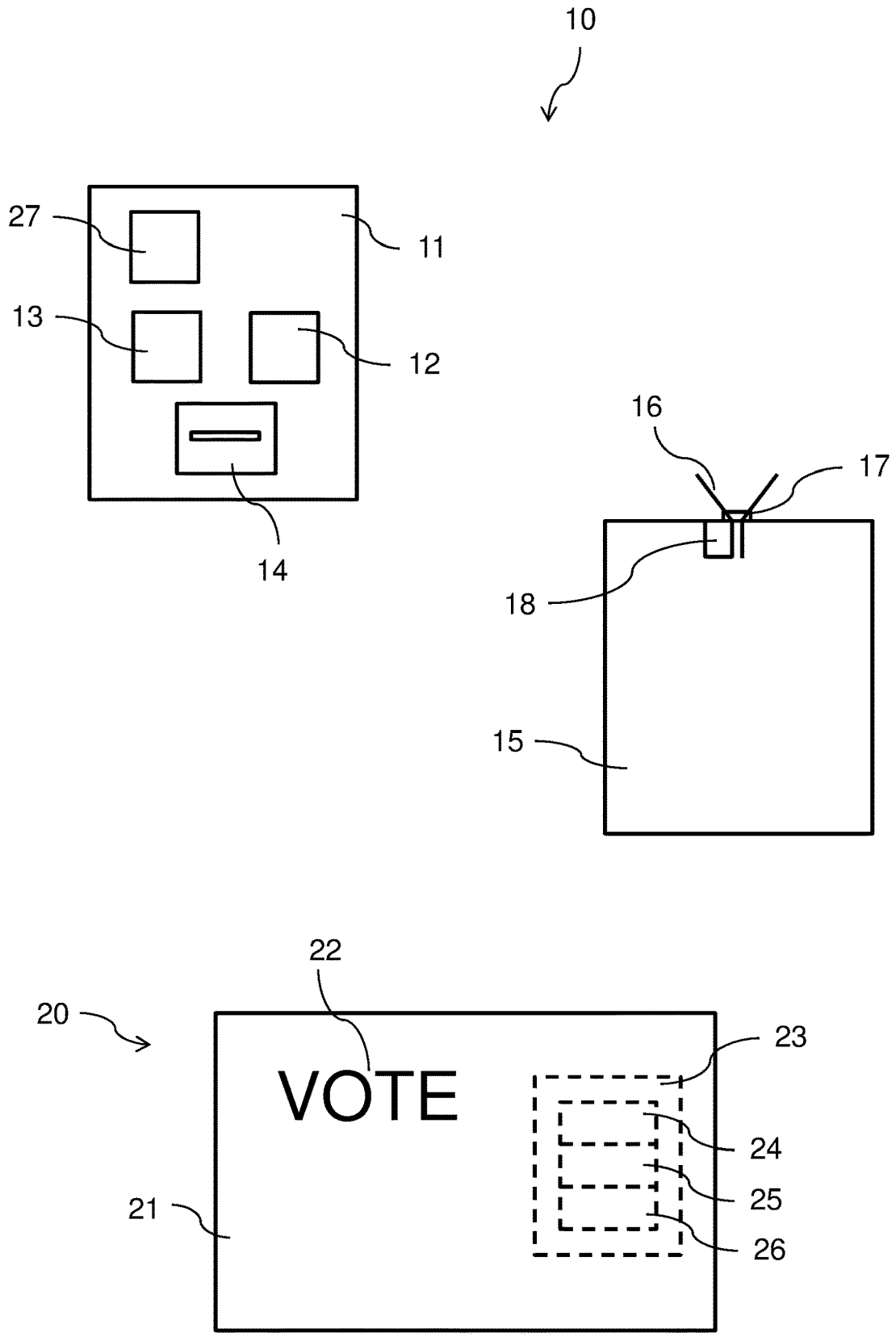
FIG. 1 represents, in a schematic view, a particular embodiment of the voting device that is the subject of the invention and, in an enlarged front view, a particular embodiment of a ballot sheet that is the subject of the invention.

FIG. 1 shows a voting device 10, which comprises a terminal 11 for selecting a candidate or a proposal put to a vote, on which terminal a voter makes his choice. This terminal 11 comprises a display screen 13 displaying the choices available to the voter and a capture device 12 capturing the selection made. This capture device 12 can be, for example, a touch screen superposed on the screen 13 or a keyboard.

The terminal 11 also comprises a store of blank ballot sheets, and a means for dispensing a ballot sheet 20 bearing the choice made:

- firstly, in an electronic memory 25; and
- secondly, on the surface 21 of the ballot sheet, in the form of a print 22, so that the voter can verify that his choice has been taken into account.

The device 10 also comprises a ballot box 15 equipped with a reader 18 of the memory 25 of the ballot sheet 20, through the envelope that conceals the printed choice. The reader 18 also performs the storage of the numbers of ballot sheets expressing the various choices made by the different voters.

This voting device 10 also comprises a means 27 for determining a code that is unique for at least the ballot in progress, independent of the identity of the voter, the order of arrival of the voter, the choice made by the voter, and any document that may have been issued prior to the time when the ballot sheet was issued, the dispensing means comprising means for writing the indeterminable code to the memory of the ballot sheet.

Note that this unique code can represent the ballot, for example by a portion of the generated code.

In some embodiments, the means 27 for determining a unique code comprises a means of generating a random code from among the codes not yet allocated to other ballot sheets. For example, this random code is in a set of codes, a set from which each generated random code is taken. In another example, the random code is generated by a random code generator and the determination means 27 verifies that this code has not already been allocated to another ballot sheet (if it has, this duplicate code is rejected and the procedure recommences).

In some embodiments, the means 27 for determining a unique code randomly generates a unique code which depends on the time defined with sufficient resolution (for example to the exact second) so that two unique code generations cannot have the same code.

In some particular embodiments of the device 10, several ballot sheets 20 keep the same identifier in memory 24, before being dispensed by the terminal 11.

When the ballot sheet 20 is issued, the terminal 11 completes this identifier by writing the unique code in a memory 26 to ensure that all the completed identifiers issued during a ballot are different.

The ballot sheet 20 preferably comprises an electronic tag 23 which comprises the memories 24, 25 and 26. In some embodiments, the electronic tag 23 of each ballot sheet 20 uses the RFID (acronym for "Radio Frequency Identification") protocol.

In other embodiments, the electronic tag utilizes the NFC (acronym for "Near Field Communication") protocol.

In some embodiments, each electronic tag 23 comprises a rewritable memory area to receive a code that completes the identifier from the terminal.

Preferably, all the ballot sheets 20 used during a ballot keep the same identifier as the ballot in memory 24, before being dispensed by the terminal 11.

The ballot box 15 comprises, in a known way, a receptacle 16 for the ballot sheets 20 and a latch 17 activated by the polling station manager to let the ballot sheet 20 pass from the receptacle 16 to the body of the ballot box 15.

For the dispensing of the ballot sheets 20 by the terminal 11, in some embodiments, the ballot sheets 20 are connected mechanically to each other in the form of a strip (not shown), the terminal 11 comprising a means (not shown) for cutting the ballot sheet strip so as to dispense the ballot sheets separately. For example, the strip of ballot sheets 20 is coiled on itself to form a roll. In this case, preferably, the ballot sheets 20 are connected to each other by thinned areas facilitating their mechanical separation.

In some embodiments, the ballot sheets 20 form, in the terminal 11, a stack (not shown) of superimposed ballot sheets with no mechanical connection to each other.

As is easily understood from reading the description of FIG. 1, by utilizing the present invention, firstly the voter can verify that his choice is expressed by his ballot sheet 20 since this sheet 20 has a visible print of his choice and, secondly, the result of the ballot is known as soon as voting closes by reading the memory of the reader 18 of ballot sheets 20. In addition, especially if contested, the result of the vote can be verified by recounting the ballot sheets 20 present in the ballot box 15 visually. The vote's anonymity is certified since it is not possible for someone who has placed blank ballot sheets 20 which all have different numbers, for example sequential, to find out which voter made which choice.

In some embodiments, the device comprises a means for printing a voting receipt, similar to a ballot sheet but with no electronic memory accepted by the ballot box but on which the unique code is printed, so that the voter can verify that his vote has been taken into account correctly, in particular when all the votes are displayed after the ballot, for example online on a website. To verify that his vote has been taken into account correctly, the voter verifies that, for his unique code printed on his receipt, the existence of a vote is properly displayed and that the choice is indeed the one printed on his receipt. In a simpler version, the receipt only contains the voter's unique code and the voter can only verify that his vote has been taken into account.

Figure 2:
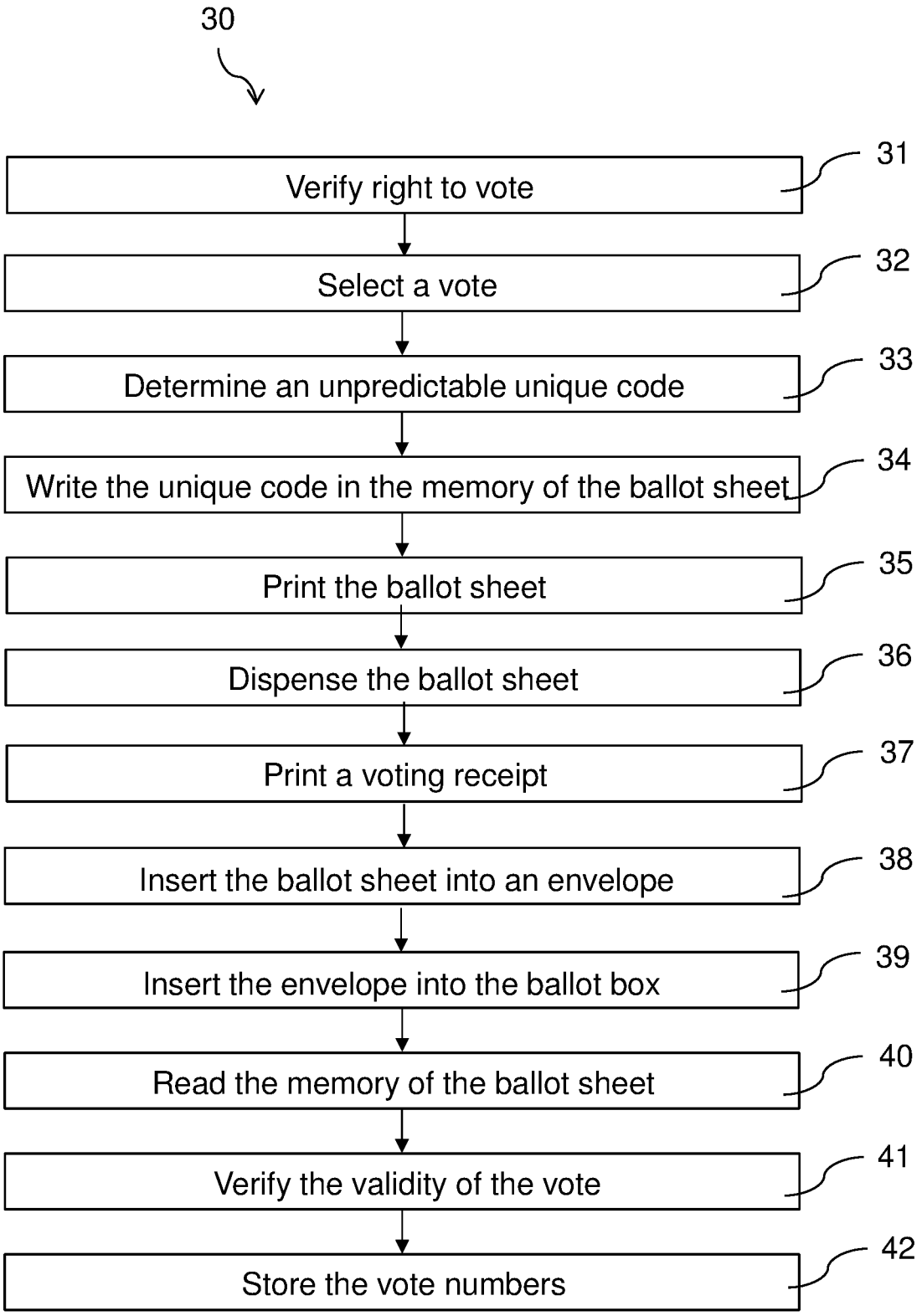
FIG. 2 represents, in the form of a logic diagram, steps in a particular embodiment of the voting method that is the subject of the invention.

As shown in FIG. 2, the voting method 30 comprises:

- a step 31 of verifying that the voter present in front of the terminal is authorized to vote, for example by automatically reading an identity document and facial recognition or by automatically reading a voter card, and then verifying that this voter hasn't already voted and is registered to vote at the polling station in question;

a step 32 of a voter selecting a candidate or a proposition put to a vote, using an interface of a terminal 11;

a step 33 of the terminal determining a code that is unique for at least the ballot in progress, independent of the identity of the voter, the order of arrival of the voter, the choice made by the voter, or any document that may have been issued prior to the time when the ballot sheet was issued;

a step 34 of the terminal writing information representative of the choice made by the voter and of the unique code to the memory 25 of a ballot sheet;

a step 35 of printing the choice made by the voter on the surface of the ballot sheet;

a step 36 of dispensing the printed ballot sheet 20 to be slid into a ballot box 15;

optionally, a step 37 of printing and dispensing a voting receipt, comprising at least one portion of the unique code and, possibly, the choice expressed by the voter;

a step 38 of inserting the ballot sheet into an envelope;

a step 39 of inserting the envelope containing the ballot sheet into the ballot box;

a step 40 of the ballot box 15 reading the memory of the ballot sheet;

an optional step 41 of verifying that the unique code and/or the code common to the ballot sheets are valid and, if invalid, of inhibiting the means for entering the ballot sheet into the body of the ballot box; and if the ballot sheet is valid, a step 42 of storing the numbers of ballot sheets expressing the various possible choices.

The invention claimed is:

1. A voting device, which comprises:

at least one ballot sheet comprising an electronic memory and a surface on which information is to be printed, a terminal for selecting a candidate or a proposal put to a vote, comprising an interface with which a voter makes a choice, the terminal comprising:

a means for writing information representative of the choice made by the voter to the memory of the ballot sheet, a means for printing the choice made by the voter on the surface of the ballot sheet, and a means for dispensing the printed ballot sheet to be slid into a ballot box; and the ballot box equipped with a reader of the memory of the ballot sheet and storage of the numbers of ballot sheets expressing the various possible choices, wherein the terminal comprises a means for determining a code that is unique for at least the ballot in progress, independent of the identity of the voter, of the order of arrival of the voter or of any document that may have been issued prior to the time when the ballot sheet was issued, and a means for writing the unique code to the memory of the ballot sheet and information representative of the choice made by the voter on the memory of the ballot sheet.

2. The device according to claim 1, wherein several ballot sheets keep the same identifier in memory, before being dispensed by the terminal, and, when the ballot sheet is issued, the terminal completes this identifier with the unique code, to ensure that all the completed identifiers issued during a vote are different.

3. The device according to claim 2, wherein all the ballot sheets used for a vote keep the same identifier in memory, before being dispensed by the terminal.

4. The device according to claim 1, wherein the means for determining a unique code comprises a means of generating a random code from among the codes not yet allocated to other ballot sheets.

5. The device according to claim 1, wherein the ballot sheets are connected mechanically to each other in the form of a strip, the terminal comprising a means for cutting the ballot sheet strip so as to dispense the ballot sheets separately.

6. The device according to claim 5, wherein the strip is coiled on itself to form a roll.

7. The device according to claim 5, wherein the ballot sheets are connected to each other by thinned areas enabling their separation.

8. The device according to claim 1, wherein the ballot sheets form a pile of ballot sheets in the terminal.

9. The device according to claim 1, wherein each ballot sheet comprises an electronic tag using the RFID (acronym for "Radio Frequency Identification") protocol.

10. The device according to claim 9, wherein each electronic tag comprises a rewritable memory area to receive a code that completes the identifier from the terminal.

11. The device according to claim 1, which comprises a means for printing a voting receipt comprising at least one portion of the unique code.

12. The device according to claim 11, wherein the means for printing the voting receipt is configured to print the voter's choice on the voting receipt.

13. A voting method, which comprises:

a step of a voter selecting a candidate or a proposition put to a vote, using an interface of a terminal;

a step of the terminal writing information representative of the choice made by the voter to the memory of a ballot sheet, the ballot sheet comprising an electronic memory and a surface on which information is to be printed;

a step of printing the choice made by the voter on the surface of the ballot sheet;

a step of dispensing the printed ballot sheet to be slid into a ballot box;

a step of inserting the ballot sheet into the ballot box;

a step of the ballot box reading the memory of the ballot sheet;

a step of storing the numbers of ballot sheets expressing the various possible choices, characterized in that it also comprises:

a step of the terminal determining a code that is unique for at least the ballot in progress, independent of the identity of the voter, of the order of arrival of the voter or of any document that may have been issued prior to the time when the ballot sheet was issued; and a step of writing the unique code to the memory of the ballot sheet.

* * * * *